US009691338B2

(12) United States Patent
Kimura et al.

(10) Patent No.: US 9,691,338 B2
(45) Date of Patent: Jun. 27, 2017

(54) LIQUID CRYSTAL DISPLAY DEVICE

(71) Applicant: Japan Display Inc., Tokyo (JP)

(72) Inventors: Susumu Kimura, Tokyo (JP); Fumitaka Gotoh, Tokyo (JP); Naoyuki Takasaki, Tokyo (JP); Tsutomu Harada, Tokyo (JP)

(73) Assignee: Japan Display Inc., Tokyo (JP)

( * ) Notice: Subject to any disclaimer, the term of this patent is extended or adjusted under 35 U.S.C. 154(b) by 41 days.

(21) Appl. No.: 14/947,669

(22) Filed: Nov. 20, 2015

(65) Prior Publication Data

US 2016/0148579 A1 May 26, 2016

(30) Foreign Application Priority Data

Nov. 25, 2014 (JP) ..... 2014-237569
Nov. 12, 2015 (JP) ..... 2015-222395

(51) Int. Cl.
*G09G 3/36* (2006.01)
*G09G 3/34* (2006.01)

(52) U.S. Cl.
CPC ..... *G09G 3/3607* (2013.01); *G09G 3/3426* (2013.01); *G09G 2300/0452* (2013.01); *G09G 2320/0276* (2013.01); *G09G 2320/0646* (2013.01); *G09G 2340/06* (2013.01); *G09G 2360/16* (2013.01)

(58) Field of Classification Search
None
See application file for complete search history.

(56) References Cited

U.S. PATENT DOCUMENTS

2005/0184998 A1 8/2005 Yang et al.
2006/0214904 A1 9/2006 Kimura et al.
2011/0181633 A1* 7/2011 Higashi ..... G09G 3/2003 345/691
2011/0181635 A1* 7/2011 Kabe ..... G09G 3/3426 345/694
2012/0299891 A1* 11/2012 Fujiwara ..... G09G 3/3426 345/207
2015/0109350 A1 4/2015 Gotoh et al.

FOREIGN PATENT DOCUMENTS

JP 2005-242300 A 9/2005
JP 2007-34251 A 2/2007
JP 2007-206560 A 8/2007

* cited by examiner

*Primary Examiner* — Joseph Haley
(74) *Attorney, Agent, or Firm* — Michael Best & Friedrich LLP

(57) ABSTRACT

According to an aspect, the liquid crystal display device includes: an expansion coefficient determining unit that determines an expansion coefficient of each of partial areas based on a signal level of the first, the second, and the third colors; a luminance level determining unit that determines a luminance level of each partial area based on the signal level; a signal processing unit that uses the expansion coefficient to expand the signal level; and a light source control unit that controls brightness of a light source based on the expansion coefficient and the luminance level. The light source can change the brightness of the partial areas individually. The light source control unit controls the light source such that the brightness of the light source in a partial area having a luminance level equal to or higher than a predetermined threshold is higher than the brightness based on the expansion coefficient.

5 Claims, 11 Drawing Sheets

FIG.9

| | R | G | B |
|---|---|---|---|
| GRADATION VALUE OF PIXEL Pix 1 (La-1) | 0 | 30 | 90 |
| GRADATION VALUE OF PIXEL Pix 2 (La-2) | 10 | 30 | 120 |
| GRADATION VALUE OF PIXEL Pix 3 (La-3) | 20 | 60 | 180 |
| AVERAGE OF GRADATION VALUES (Lb) | 10 | 40 | 130 |
| AVERAGE OF GRADATION LEVELS (Lc) | 1 | 4 | 13 |
| AVERAGE OF GRADATION LEVELS WITH LUMINOUS EFFICIENCY TAKEN INTO CONSIDERATION (Ld) | 0.3 | 2.4 | 1.3 |
| SUM (Le) | 4 | | |

FIG.10

EXPANSION COEFFICIENT ($\alpha$)

| | | |
|---|---|---|
| (210A) 4 | (210B) 1 | (210C) 3.3 |
| (210D) 2 | (210E) 1.5 | (210F) 1.5 |
| (210G) 4 | (210H) 4 | (210I) 4 |

BRIGHTNESS OF LIGHT SOURCE (%)

| | | |
|---|---|---|
| (61A) 25 | (61B) 100 | (61C) 30 |
| (61D) 50 | (61E) 67 | (61F) 67 |
| (61G) 25 | (61H) 25 | (61I) 25 |

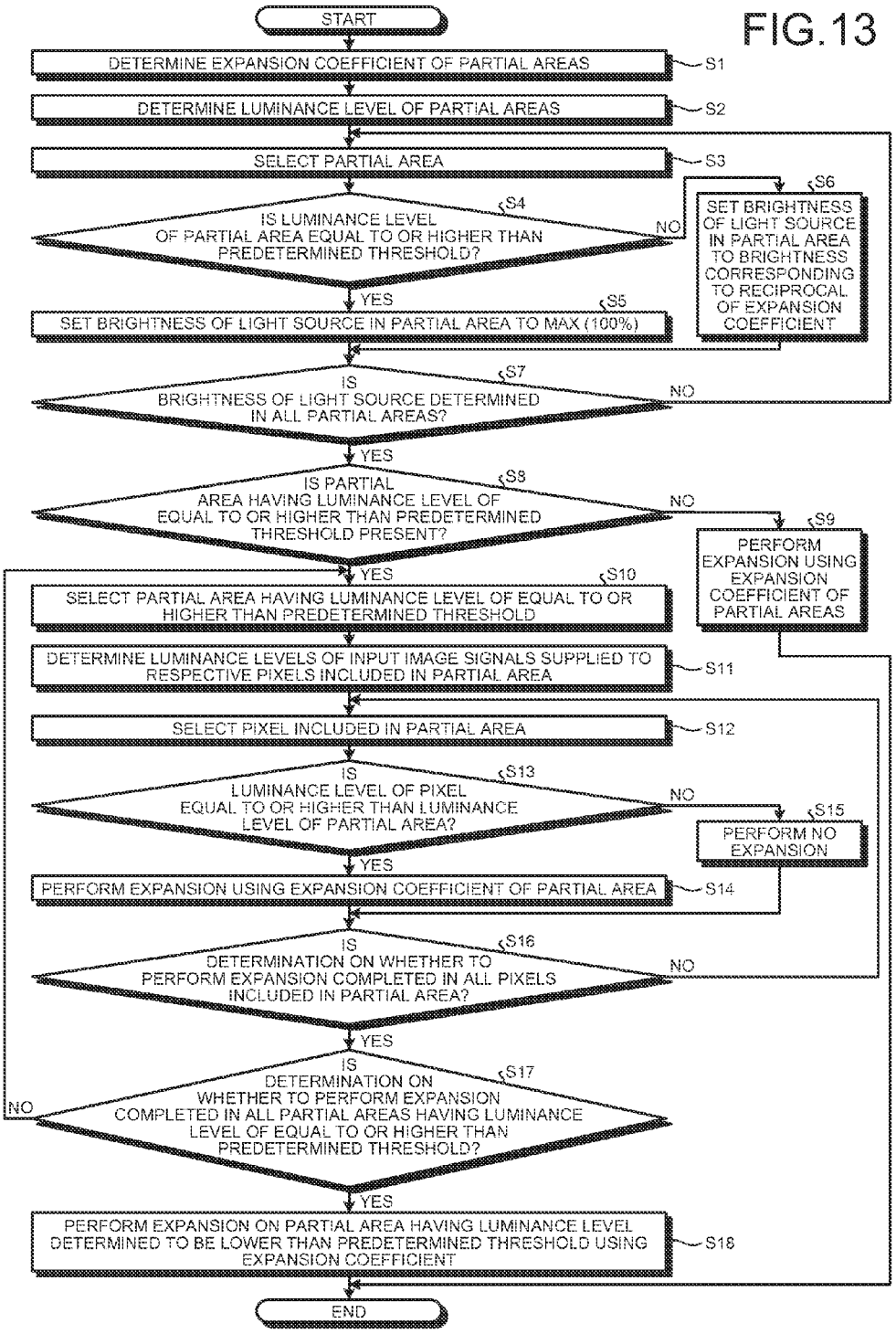
FIG.13
START
DETERMINE EXPANSION COEFFICIENT OF PARTIAL AREAS
S1
DETERMINE LUMINANCE LEVEL OF PARTIAL AREAS
S2
SELECT PARTIAL AREA
S3
IS LUMINANCE LEVEL OF PARTIAL AREA EQUAL TO OR HIGHER THAN PREDETERMINED THRESHOLD?
S4
NO
SET BRIGHTNESS OF LIGHT SOURCE IN PARTIAL AREA TO BRIGHTNESS CORRESPONDING TO RECIPROCAL OF EXPANSION COEFFICIENT
S6
YES
SET BRIGHTNESS OF LIGHT SOURCE IN PARTIAL AREA TO MAX (100%)
S5
IS BRIGHTNESS OF LIGHT SOURCE DETERMINED IN ALL PARTIAL AREAS?
S7
NO
YES
IS PARTIAL AREA HAVING LUMINANCE LEVEL OF EQUAL TO OR HIGHER THAN PREDETERMINED THRESHOLD PRESENT?
S8
NO
PERFORM EXPANSION USING EXPANSION COEFFICIENT OF PARTIAL AREAS
S9
YES
SELECT PARTIAL AREA HAVING LUMINANCE LEVEL OF EQUAL TO OR HIGHER THAN PREDETERMINED THRESHOLD
S10
DETERMINE LUMINANCE LEVELS OF INPUT IMAGE SIGNALS SUPPLIED TO RESPECTIVE PIXELS INCLUDED IN PARTIAL AREA
S11
SELECT PIXEL INCLUDED IN PARTIAL AREA
S12
IS LUMINANCE LEVEL OF PIXEL EQUAL TO OR HIGHER THAN LUMINANCE LEVEL OF PARTIAL AREA?
S13
NO
PERFORM NO EXPANSION
S15
YES
PERFORM EXPANSION USING EXPANSION COEFFICIENT OF PARTIAL AREA
S14
IS DETERMINATION ON WHETHER TO PERFORM EXPANSION COMPLETED IN ALL PIXELS INCLUDED IN PARTIAL AREA?
S16
NO
YES
IS DETERMINATION ON WHETHER TO PERFORM EXPANSION COMPLETED IN ALL PARTIAL AREAS HAVING LUMINANCE LEVEL OF EQUAL TO OR HIGHER THAN PREDETERMINED THRESHOLD?
S17
NO
YES
PERFORM EXPANSION ON PARTIAL AREA HAVING LUMINANCE LEVEL DETERMINED TO BE LOWER THAN PREDETERMINED THRESHOLD USING EXPANSION COEFFICIENT
S18
END

LIQUID CRYSTAL DISPLAY DEVICE

CROSS-REFERENCE TO RELATED APPLICATIONS

This application claims priority from Japanese Application No. 2014-237569, filed on Nov. 25, 2014 and Japanese Application No. 2015-222395, filed on Nov. 12, 2015, the contents of which are incorporated by reference herein in its entirety.

BACKGROUND

1. Technical Field

The present invention relates to a liquid crystal display device.

2. Description of the Related Art

Transmissive liquid crystal display devices include a backlight on the back surface of pixels provided with color filters of red, blue, and green, for example. As described in Japanese Patent Application. Laid-open Publication No. 2007-34251, for example, liquid crystal display devices display an image by driving liquid crystals in the pixels so as to adjust the transmission amount of light output from a light source of the backlight.

The brightness of transmissive liquid crystal display devices is reduced by the amount of light prevented from being transmitted therethrough out of light from the light source. Because the light from the light source need to pass through the components provided to the pixels, such as the liquid crystals, it is extremely difficult to completely transmit the light from the light source therethrough. As a result, the conventional liquid crystal display devices may possibly have difficulty in enhancing the brightness compared with self-luminous display devices, thereby failing to sufficiently secure the brightness with respect to required brightness.

For the foregoing reasons, there is a need for a liquid crystal display device capable of obtaining a brighter display output.

SUMMARY

According to an aspect, a liquid crystal display device includes: a display pixel unit having a display area in which a plurality of pixels are arranged in a matrix, the pixels each including sub-pixels of a first color, a second color, a third color, and a fourth color; a light source that outputs light to be incident, on the display pixel unit, the light passing through the pixels and being controlled based on input image signals to display an image; an expansion coefficient determining unit that determines an expansion coefficient for each of a plurality of partial areas based on a signal level of the first color, the second color, and the third color indicated by the input image signals, the expansion coefficient indicating a relation between transmittance of the pixels and brightness of the light source, the partial areas being provided in a manner dividing the display area; a luminance level determining unit that determines a luminance level of each of the partial areas based on the signal level of the first color, the second color, and the third color indicated by the input image signals; a signal processing unit that uses the expansion coefficient to expand the signal level of the first color, the second color, and the third color indicated by the input image signals, extracts a signal component of the fourth color from the expanded signals of the first color, the second color, and the third color, and determines the signal level of the first color, the second color, the third color, and the fourth color based on the extracted signal component of the fourth color; and a light source control unit that controls the brightness of the light source based on the expansion coefficient and the luminance level. The light source is capable of changing the brightness of the partial areas individually. The light source control unit controls the light source such that the brightness of the light source in a partial area having a luminance level equal to or higher than a predetermined threshold is higher than the brightness based on the expansion coefficient.

BRIEF DESCRIPTION OF THE DRAWINGS

FIG. 9 is a diagram of an example of input image signals for three pixels sampled in a partial area and various values calculated from the input image signals;

FIG. 10 is a diagram of an example of a relation between an expansion coefficient of a plurality of partial areas and the brightness of the light source;

FIG. 13 is an exemplary flowchart of expansion and processing for controlling the light source of a backlight;

DETAILED DESCRIPTION

Figure 1:
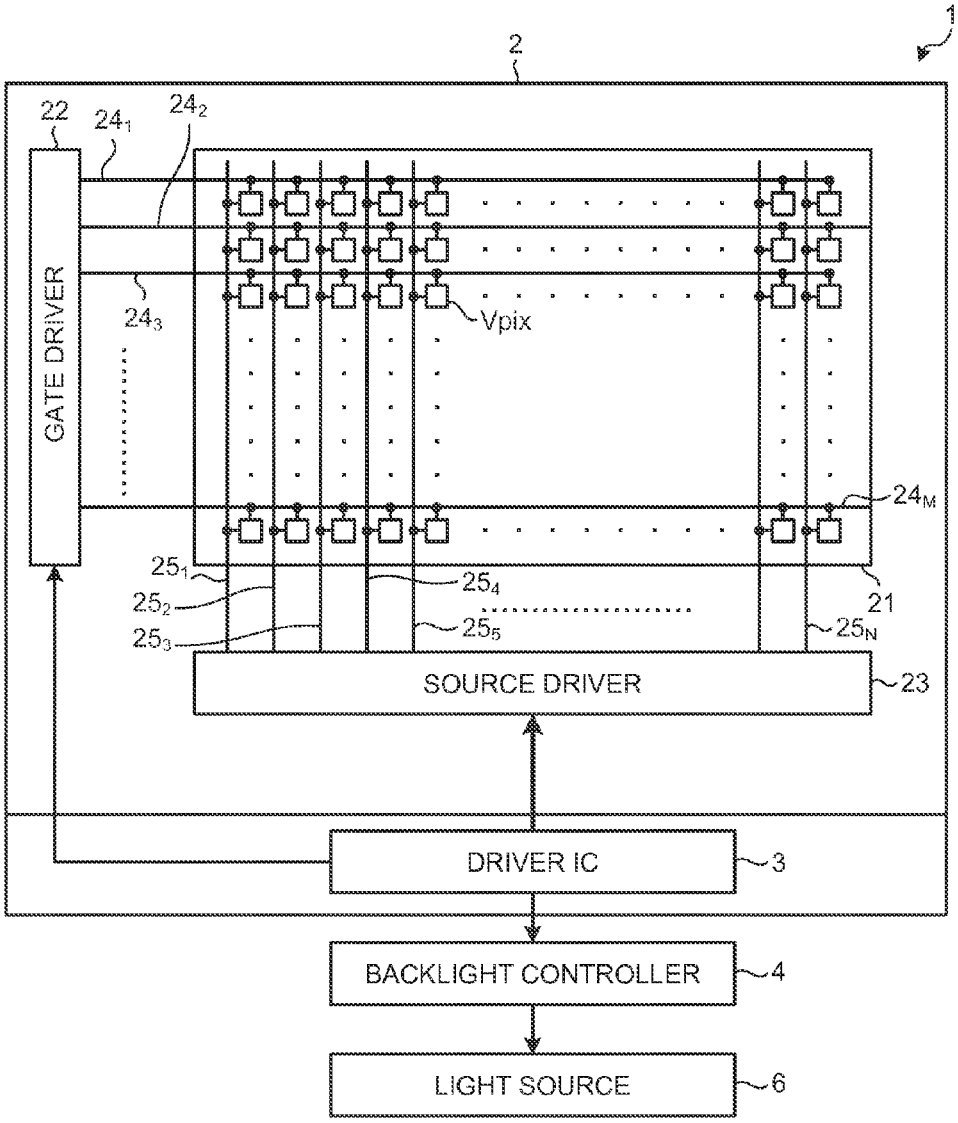
FIG. 1 is a block diagram of an exemplary system configuration of a liquid crystal display device according to an embodiment.

Exemplary embodiments according to the present invention are described below with reference to the accompanying drawings. The disclosure is given by way of example only. Various changes and modifications made without departing from the spirit of the invention and easily conceivable by those skilled in the art are naturally included in the scope of the invention. To simplify the explanation, the drawings may possibly illustrate the width, the thickness, the shape, and other elements of each unit more schematically than the actual aspect. These elements, however, are given by way of example only and are not intended to limit interpretation of the invention. In the specification and the figures, components similar to those previously described with reference to a preceding figure are denoted by like reference numerals, and overlapping explanation thereof will be appropriately omitted.

FIG. 1 is a block diagram of an exemplary system configuration of a liquid crystal display device according to an embodiment. The liquid crystal display device 1 corresponds to a specific example of the liquid crystal display device according to the present invention.

The liquid crystal display device 1 is a transmissive liquid crystal display device and includes a display panel 2, a driver integrated circuit (IC) 3, a backlight controller 4, and a light source 6. Flexible printed circuits (FPCs), which are not illustrated, transmit an external signal to the driver IC 3 or electric power for driving the driver IC 3. The display panel 2 includes a translucent insulation substrate such as a glass substrate, a display area 21, a gate driver (vertical drive circuit) 22, and a source driver (horizontal drive circuit) 23. The display area 21 is provided on the surface of the glass substrate and has a number of pixels Pix (refer to FIG. 2) that include a liquid crystal cell and are arranged in a matrix (rows and columns). The glass substrate includes a first substrate and a second substrate. The first substrate is provided with a number of pixel circuits that include an active element (e.g., a transistor) and are arranged in a matrix. The second substrate is arranged facing the first substrate with a predetermined gap interposed therebetween. The gap between the first substrate and the second substrate is maintained at a predetermined gap by a photo-spacer arranged at each position on the first substrate. Liquid crystals are sealed between the first substrate and the second substrate. The arrangement and the size of each unit, such as the display area 21, in the display panel 2 illustrated in FIG. 1 are given by way of schematic example only and does not reflect the actual arrangement.

The display panel 2 includes the display area 21, the driver IC 3 having functions of an interface (I/F) and a timing generator, the gate driver 22, and the source driver 23 on the glass substrate.

The display area 21 has a matrix (row-and-column) structure in which M×N sub-pixels Vpix including a liquid crystal layer are arranged. In the present specification, a row indicates a pixel, row including N sub-pixels Vpix arrayed in a direction. A column indicates a pixel column including M sub-pixels Vpix arrayed in a direction orthogonal to the direction in which the row extends. The values of M and N are determined based on the display resolution in the vertical direction and that in the horizontal direction, respectively. In the array of M×N sub-pixels Vpix in the display area 21, scanning lines $\mathbf{24}_1$, $\mathbf{24}_2$, $\mathbf{24}_3$, . . . , $\mathbf{24}_M$ are arranged as rows, and signal lines $\mathbf{25}_1$, $\mathbf{25}_2$, $\mathbf{25}_3$, . . . , $\mathbf{25}_N$ are arranged as columns. In the present embodiment, the scanning lines $\mathbf{24}_1$, $\mathbf{24}_2$, $\mathbf{24}_3$, . . . , $\mathbf{24}_M$ may be collectively referred to as a scanning line 24, whereas the signal lines $\mathbf{25}_1$, $\mathbf{25}_2$, $\mathbf{25}_3$, . . . , $\mathbf{25}_N$ may be collectively referred to as a signal line 25. In the present embodiment, arbitrary three scanning lines out of the scanning lines $\mathbf{24}_1$, $\mathbf{24}_2$, $\mathbf{24}_3$, . . . , $\mathbf{24}_M$ are referred, to as scanning lines $\mathbf{24}_m$, $\mathbf{24}_{m+1}$, and $\mathbf{24}_{m+2}$ (m is a natural number satisfying in $m \leq M-2$), whereas arbitrary four signal lines out of the signal lines $\mathbf{25}_1$, $\mathbf{25}_2$, $\mathbf{25}_3$, . . . , $\mathbf{25}_N$ are referred to as signal lines $\mathbf{25}_n$, $\mathbf{25}_{n+1}$, $\mathbf{25}_{n+2}$, and $\mathbf{25}_{n+3}$ (n is a natural number satisfying $n \leq N-3$).

The liquid crystal display device 1 receives a master clock, a horizontal synchronizing signal, and a vertical synchronizing signal, which are external signals from the outside. These signals are for the driver IC 3. The driver IC 3 converts the level of the master clock, the horizontal synchronizing signal, and the vertical synchronizing signal at a voltage amplitude of an external power source into a level at a voltage amplitude of an internal power source required to drive the liquid crystals. Thus, the driver IC 3 generates a master clock, a horizontal synchronizing signal, and a vertical synchronizing signal. The driver IC 3 supplies the generated master clock to the gate driver 22 and the source driver 23, the generated vertical synchronizing signal to the gate driver 22, and the generated horizontal synchronizing signal to the source driver 23. The driver IC 3 generates a common potential to be supplied to sub-pixels in common by a common electrode COM, which will be described later, of each sub-pixel Vpix and supplies the common potential to the display area 21.

The gate driver 22 sequentially samples and latches, in one horizontal period, display data output from the driver IC 3 in synchronization with a vertical clock pulse. The gate driver 22 sequentially outputs and supplies the latched digital data of one line as a vertical scanning pulse to the scanning lines $\mathbf{24}_m$, $\mathbf{24}_{m+1}$, $\mathbf{24}_{m+2}$, . . . of the display area 21. Thus, the gate driver 22 sequentially selects sub pixels Vpix row by row. The gate driver 22, for example, outputs the digital data to the scanning lines $\mathbf{24}_m$, $\mathbf{24}_{m+1}$, $\mathbf{24}_{m+2}$, . . . from the top of the display area 21, that is, the upper side in the vertical scanning, to the bottom of the display area 21, that is, the lower side in the vertical scanning in order. Alternatively, the gate driver 22 may output the digital data to the scanning lines $\mathbf{24}_m$, $\mathbf{24}_{m+1}$, $\mathbf{24}_{m+2}$, . . . from the bottom of the display area 21, that is, the lower side in the vertical scanning, to the top of the display area 21, that is, the upper side in the vertical scanning in order.

The source driver 23 is supplied with 8-bit digital data of four colors (e.g., R (red), G (green), B (blue), and W (white)), for example. The source driver 23 writes display data to the sub-pixels Vpix of the row selected in the vertical scanning performed by the gate driver 22 in units of a sub-pixel, in units of a plurality of sub-pixels, or in one unit of all the sub-pixels via the signal lines 25.

Some types of methods for driving a liquid crystal display panel are known, including line inversion, dot inversion, and frame inversion driving methods. The line inversion driving method is a method for reversing the polarity of video signals at a time period of 1H (H represents a horizontal scanning period) corresponding to one line (one pixel row). The dot inversion driving method is a method for alternately reversing the polarity of video signals for sub-pixels vertically and horizontally adjacent to each other. The frame inversion driving method is a method for reversing the polarity of video signals to be written to all the sub-pixels in one frame corresponding to one screen with the same polarity at a time. The liquid crystal display device 1 may employ any one of the driving methods described above.

Figure 2:
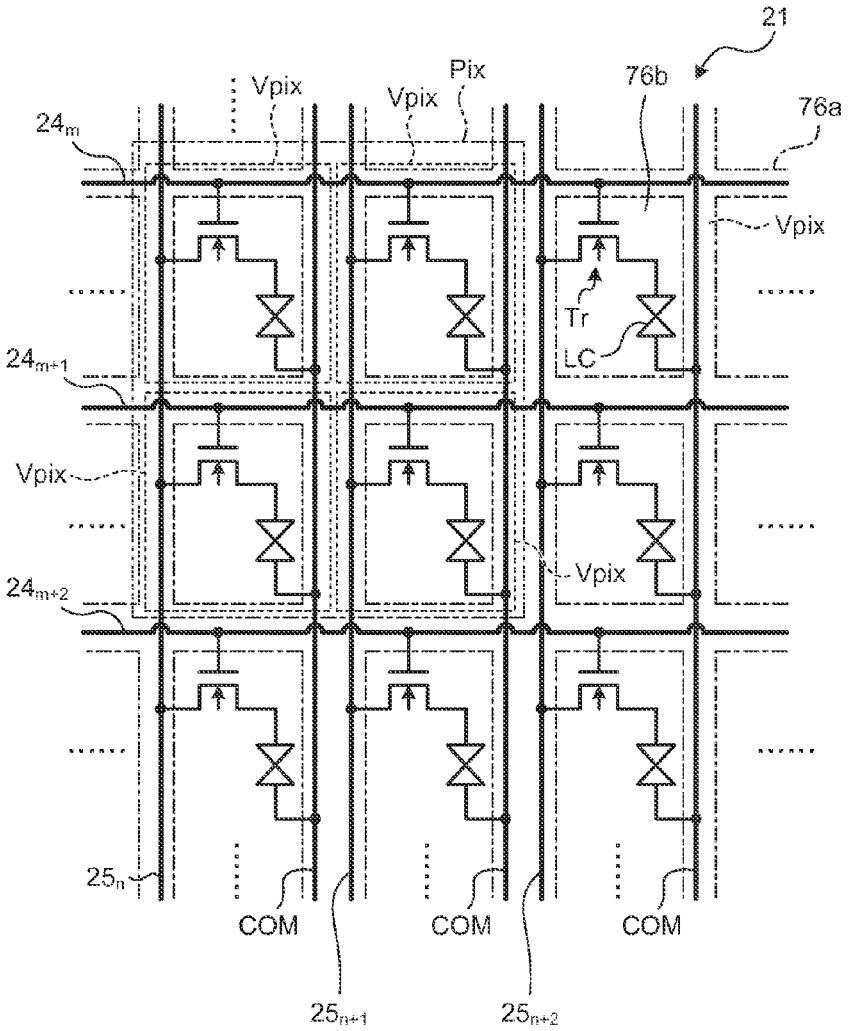
FIG. 2 is a circuit diagram of a drive circuit that drives pixels of the liquid crystal display device according to the present embodiment.

FIG. 2 is a circuit diagram of a drive circuit that drives the pixels Pix of the liquid crystal display device 1 according to the embodiment. In the display area 21, wiring of the signal lines $\mathbf{25}_n$, $\mathbf{25}_{n+1}$, $\mathbf{25}_{n+2}$ and the scanning lines $\mathbf{24}_m$, $\mathbf{24}_{m+1}$, $\mathbf{24}_{m+2}$ are formed, for example. The signal lines $\mathbf{25}_n$, $\mathbf{25}_{n+1}$, $\mathbf{25}_{n+2}$ supply pixel signals serving as display data to thin film transistor (TFT) elements Tr in respective sub-pixels Vpix. The scanning lines $\mathbf{24}_m$, $\mathbf{24}_{m+1}$, $\mathbf{24}_{m+2}$ drive the TFT elements Tr. The signal lines $\mathbf{25}_n$, $\mathbf{25}_{n+1}$, $\mathbf{25}_{m+2}$ extend on a plane parallel to the surface of the glass substrate and supply the pixel signals to display an image no the sub-pixels Vpix. The sub-pixels Vpix each include the TFT element Tr and a liquid crystal element. LC. The TFT element Tr is made of a TFT, and specifically of an n-channel metal oxide semiconductor (MOS) TFT in this example. One of the source and the drain of the TFT element Tr is coupled to the corresponding one of the signal lines $\mathbf{25}_n$, $\mathbf{25}_{n+1}$, $\mathbf{25}_{n+2}$, the gate thereof is coupled to the corresponding one of the scanning lines $\mathbf{24}_m$, $\mathbf{24}_{m+1}$, $\mathbf{24}_{m+2}$, and the other of the source and the drain thereof is coupled to a first end of the liquid crystal element LC. The first end of the liquid crystal element LC is coupled to the other of the source and the drain of the TFT element Tr, and a second end thereof is coupled to the corresponding common electrode COM.

The sub-pixel Vpix is coupled to other sub-pixels Vpix belonging to the same row in the display area 21 by the scanning lines $\mathbf{24}_m$, $\mathbf{24}_{m+1}$, and $\mathbf{24}_{m+2}$. The scanning lines $\mathbf{24}_m$, $\mathbf{24}_{m+1}$, and $\mathbf{24}_{m+2}$ are coupled to the gate driver 22 and supplied with vertical scanning pulses of scanning signals from the gate driver 22. The sub-pixel Vpix is further coupled to other sub-pixels Vpix belonging to the same column in the display area 21 by the signal lines $\mathbf{25}_n$, $\mathbf{25}_{n+1}$, and $\mathbf{25}_{n+2}$. The signal lines $\mathbf{25}_n$, $\mathbf{25}_{n+1}$, and $\mathbf{25}_{n+2}$ are coupled to the source driver 23 and supplied with pixel signals from the source driver 23. The sub-pixel Vpix is further coupled to the other sub-pixels Vpix belonging to the same column in the display area 21 by the common electrode COM. The common electrode COM is coupled to a drive electrode driver, which is not illustrated, and supplied with drive signals from the drive electrode driver.

The gate driver 22 illustrated in FIG. 1 applies vertical scanning pulses to the gate of the TFT element Tr in the sub-pixels Vpix via the scanning lines $\mathbf{24}_m$, $\mathbf{24}_{m+1}$, and $\mathbf{24}_{m+2}$ illustrated in FIG. 2. Thus, the gate driver 22 sequentially selects a row (a horizontal line) of the sub-pixels Vpix arranged in a matrix in the display area 21 as a target of display drive. The source driver 23 illustrated in FIG. 1 supplies pixel signals to the sub-pixels Vpix belonging to the horizontal line sequentially selected by the gate driver 22 via the signal lines $\mathbf{25}_n$, $\mathbf{25}_{n+1}$, and $\mathbf{25}_{n+2}$ illustrated in FIG. 2. These sub-pixels Vpix perform display of the horizontal line based on the supplied pixel signals. The drive electrode driver applies drive signals, thereby driving the common electrodes COM in each drive electrode block, including a predetermined number of common electrodes COM.

As described above, the gate driver 22 in the liquid crystal display device 1 drives the scanning lines $\mathbf{24}_m$, $\mathbf{24}_{m+1}$, and $\mathbf{24}_{m+2}$ for sequential scanning, thereby sequentially selecting a horizontal line. The source driver 23 in the liquid crystal display device 1 supplies the pixel signals to the sub-pixels Vpix belonging to the horizontal line, thereby performing display of the horizontal line. To perform the display operation, the drive electrode driver applies the drive signals to the common electrodes COM corresponding to the horizontal line.

The display area 21 includes a color filter. The color filter includes a grid-shaped black matrix 76*a* and apertures 76*b*. The black matrix 76*a* is formed to cover the outer periphery of the sub-pixel Vpix as illustrated in FIG. 2. In other words, the black matrix 76*a* is arranged at a boundary between the two-dimensionally arranged sub-pixels Vpix and thus is formed into a grid shape. The black matrix 76*a* is made of a material having a high light-absorption rate. The apertures 76*b* each serve as an aperture formed by the grid, shape of the black matrix 76*a* and are arranged at positions corresponding to the respective sub-pixels Vpix.

The apertures 76*b* include color areas corresponding to output sub-pixels of four colors. Specifically, the apertures 76*b* include color areas colored with three colors of red (R), green (G), and blue (B), which are an aspect of the first, the second, and the third colors, and a color area colored with the fourth color (e.g., white (W)), for example. The color filter, for example, has the color areas of the three colors of red (R), green (G), and blue (B) periodically arrayed on the respective apertures 76*b*. In a case where the fourth color is white (W), no color is provided to the apertures 76*b* of white (W) by the color filter. In a case where the fourth color is another color, the color employed as the fourth color is provided by the color filter. In the present embodiment, the sub-pixels Vpix illustrated in FIG. 2 are provided with the respective our colors including the color areas of the three colors of red (R), green (G), and blue (B), and the fourth color (e.g., white (W)) and serve as a pixel Pix as a set. As described above, the display panel 2 includes a plurality of pixels (pixels Pix) in which the output sub-pixels (sub-pixels Vpix) of red (R), green (G), blue (B), and the fourth color (e.g., white (W)) are arrayed. The display panel 2 serves as a display pixel unit including a display area (e.g., the display area 21) in which the pixels are arranged in a matrix. The input image signal for a pixel according to the present embodiment is an input image signal corresponding to output from the pixel Pix including the sub-pixels Vpix of red (R), green (G), blue (B), and she fourth color (e.g., white (W)). Hereinafter, red (R), green (G), blue (B), and white (W) may simply be referred to as R, G, B, and W, respectively. The combination of red (R), green (G), and blue (B) may be referred to as RGB, and the combination of red (R), green (G), blue (B), and white (W) may be referred to as RGBW.

The color filter may be a combination of other colors as long as it is colored with different colors. In general color filters, the luminance of the color area of G is higher than those of the color areas of R and B. In a case where the fourth color is W, the color filter may be made of a light transmissive resin to produce a white color.

Viewed in a direction orthogonal to the front surface, the scanning line 24 and the signal line 25 in the display area 21 are arranged at an area overlapping with the black matrix 76*a* of the color filter. In other words, the scanning line 24 and the signal line 25 are hidden behind the black matrix 76*a* viewed in a direction orthogonal to the front surface. In the display area 21, an area provided with no black matrix 76*a* corresponds to the aperture 76*b*.

As illustrated in FIG. 2, the scanning lines $\mathbf{24}_m$, $\mathbf{24}_{m+1}$, $\mathbf{24}_{m+2}$ are arranged at regular intervals, and the signal lines $\mathbf{25}_n$, $\mathbf{25}_{n+1}$, $\mathbf{25}_{n+2}$ are also arranged at regular intervals. The sub-pixels Vpix are arranged facing in the same direction at the respective areas sectioned by the scanning lines $\mathbf{24}_m$, $\mathbf{24}_{m+1}$, $\mathbf{24}_{m+2}$, and the signal lines $\mathbf{25}_n$, $\mathbf{25}_{n+1}$, $\mathbf{25}_{n+2}$.

Figure 3:
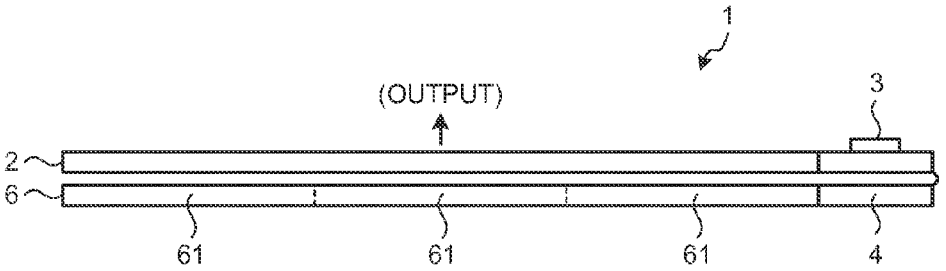
FIG. 3 is a schematic diagram of an example of a light source that outputs light to be incident on a display panel.

FIG. 3 is a schematic diagram of an example of the light source 6 that outputs light to be incident on the display panel 2. As illustrated in FIG. 3, the light source 6 serving as a backlight is provided on the back surface of the display panel 2 serving as the display pixel unit. Light output from light source 6 is incident on the display area. Therefore, the light source 6 serves as a light source in display output performed by the liquid crystal display device 1.

Figure 4:
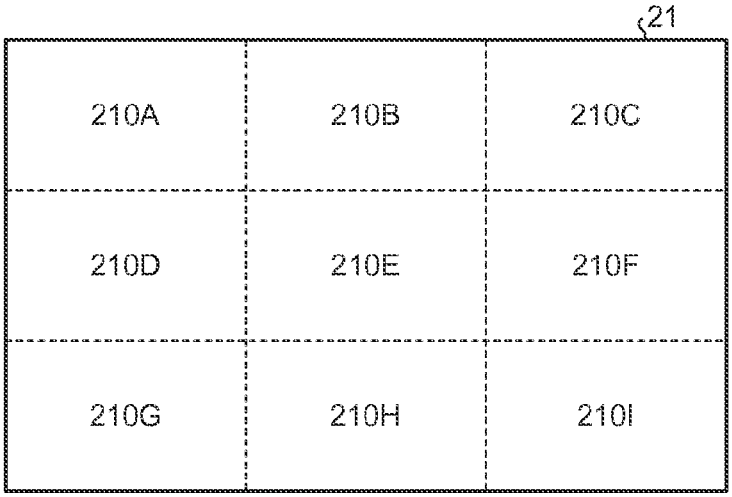
FIG. 4 is a diagram of an example of a relation between a display area and partial areas.

FIG. 4 is a diagram of an example of a relation between the die-lay area and partial areas 210A, 210B, 210C, 210D, 210E, 210F, 210G, 210H, and 210I. The display area 21 according to the present embodiment is divided into a plurality of partial areas (e.g., nine partial areas 210A to 210I). In other words, the display area composed of a plurality of pixels Pix is divided into the partial area 210A to 210I. The light source 6 can individually change the brightness of the partial areas 210A to 210I that divide the display area. Specifically, the light source 6 includes a plurality of light-emitting devices, such as organic light-emitting diode (OLED) illumination panels 61, provided on the hack surface side of the respective partial areas 210A to 210I, for example. The light source 6 can control operations of the light-emitting devices individually. While the display area illustrated in FIG. 4 is divided into the nine partial areas 210A to 210I, the configuration is given by way of example only, and the embodiment is not limited thereto. The number, the shape, and the arrangement of the partial areas and a specific configuration of the light-emitting devices included in the light source 6 can be appropriately changed. The light source 6, for example, may include an inorganic light-emitting diode (LED) instead of the OLED. In a case where the present invention is applied to a reflective display device, for example, the light source 6 may be provided not on the back surface side of the display area but on the front surface side thereof. When it is unnecessary to distinguish the partial areas 210A to 210I from one another in the following description, they are referred to as partial areas 210.

The driver IC 3 according to the present embodiment converts image data into digital data and outputs the digital data to the source driver 23. The image data is based on input image signals composed of a combination of signal levels (e.g., 0 to 255 in the case of 8 bits) indicating the gradation values of the three colors of R, G, and B received from the outside. The digital data is composed of a combination of signal levels indicating the gradation values of the our colors of R, G, B, and the fourth color (e.g., W). The gradation value of each color corresponds to the value of brightness and the saturation of the component of the color in output from the pixel. The signal level (gradation value) in the digital data corresponds to the transmittance of the sub-pixels Vpix constituting the pixel Pix. The transmittance of the sub-pixel Vpix indicates the degree of transmission of light output from the light source 6 through the sub-pixel Vpix. When the signal level is the lowest (0 in the case of 8 bits), the transmittance of the sub-pixel Vpix is the lowest; whereas when the signal level is the highest (255 in the case of 8 bits), the transmittance of the sub-pixel Vpix is the highest. In other words, the gradation value correlates with the luminance in output. The luminance, however, is weighted for each color based on the luminous efficiency, which will be described later. By contrast, the value of brightness is the degree of brightness in units of a color (light and darkness). The value of brightness has no relation with whether the color looks brighter than other colors. The number of bits of the signal level can be appropriately changed. The degree of gradation expression varies depending on the number of bits of the signal level indicating the gradation value.

Figure 5:
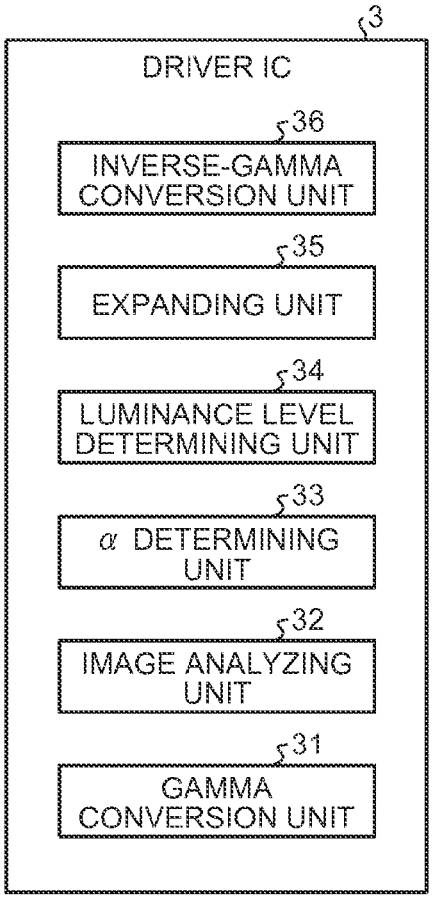
FIG. 5 is a diagram of an example of a configuration for converting an input image signal.

The following describes a configuration and processing for converting an input image signal and controlling the light source 6. FIG. 5 is a diagram of an example of a configuration for converting an input image signal. As illustrated in FIG. 5, or example, the driver IC 3 includes a gamma conversion unit 31, an image analyzing unit 32, an α determining unit 33, a luminance level determining unit 34, an expanding unit 35, and an inverse-gamma conversion unit 36. The gamma conversion unit 31 performs gamma conversion to convert the correspondence relation between the gradation and the luminance of an image based on data into a predetermined relation. The image analyzing unit 32 analyzes the gradation values of input image signals for a plurality of pixels constituting an image subjected to gamma conversion. The α determining unit 33 determines an expansion coefficient indicating the relation between the transmittance of the pixel Pix and the brightness of the light source 6 in each of the partial areas 210 based on the signal level of red, green, and blue indicated by the input image signals. The luminance level determining unit 34 determines the luminance level indicating the degree of luminance in each of the partial areas 210 based on the signal level of red, green, and blue indicated by the input image signals. The expanding unit 35 uses the expansion coefficient to expand the signal level of red, green, and blue indicated by the input image signals. The expanding unit 35 extracts a signal component of the fourth color from the expanded signal of red, green, and blue. Based on the extracted signal component of the fourth color, the expanding unit 35 determines the signal level of red, green, blue, and white. The inverse-gamma conversion unit 36 restores the correspondence relation between the gradation and the luminance of the image resulting from the processing performed by the expanding unit 35 into the correspondence relation prior to gamma conversion.

As illustrated in FIGS. 1 and 3, the driver IC 3 is coupled to the backlight controller 4. The backlight controller 4 serves as a light source control unit that controls the brightness of the light source 6 based on the expansion coefficient and the luminance level. The control on the brightness of the light source 6 performed by the backlight controller 4 will be described later in greater detail.

Processing for determining a will be described. The following describes a basic principle in replacement of the combination of the gradation values of R, G, and B indicated by an input image signal with the combination of the gradation values of R, G, B, and W. The following describes processing performed based on an input image signal for one pixel Pix, for example.

Let us assume that an input image signal is an RGB digital signal as described above. To prevent a change in the display quality of displayed video, the relation expressed by the following Equation (1) needs to be satisfied where Ro, Go, Bo, and Wo denote the signals of the respective colors for performing display on pixels of RGBW.

$$Ri:Gi:Bi=Ro+Wo:Go+Wo:Bo+Wo \quad (1)$$

The relations expressed by the following Equations (2) to (4) are satisfied where Max(Ri,Gi,Bi) denotes the maximum value of the signal Ri, Gi, Bi. Thus, the relations expressed by the following Equations (5) to (7) are satisfied.

$$Ri/\mathrm{Max}(Ri,Gi,Bi)=(Ro+Wo)/(\mathrm{Max}(Ri,Gi,Bi)+Wo) \quad (2)$$

$$Gi/\mathrm{Max}(Ri,Gi,Bi)=(Go+Wo)/(\mathrm{Max}(Ri,Gi,Bi)+Wo) \quad (3)$$

$$Bi/\mathrm{Max}(Ri,Gi,Bi)=(Bo+Wo)/(\mathrm{Max}(Ri,Gi,Bi)+Wo) \quad (4)$$

$$Ro=Ri\times((\mathrm{Max}(Ri,Gi,Bi)+Wo)/\mathrm{Max}(Ri,Gi,Bi))Wo \quad (5)$$

$$Go=Ri\times((\mathrm{Max}(Ri,Gi,Bi)+Wo)/\mathrm{Max}(Ri,Gi,Bi))Wo \quad (6)$$

$$Bo=Ri\times((\mathrm{Max}(Ri,Gi,Bi)+Wo)/\mathrm{Max}(Ri,Gi,Bi))Wo \quad (7)$$

Wo settable herein can be expressed by the following Equation (8) as a function of the minimum value Min(Ri, Gi,Bi) of Ri, Gi, Bi where f denotes a desired coefficient. In other words, Wo is expressed by the following Equation (9) in the simplest manner.

$$Wo=f(\mathrm{Min}(Ri,Gi,Bi)) \quad (8)$$

$$Wo=\mathrm{Min}(Ri,Gi,Bi) \quad (9)$$

Based on the above Equations (8) and (9), if an image signal satisfying Min(Ri,Gi,Bi)=0 is present, Wo=0 is satisfied. In this case, the luminance of the pixel is not enhanced. If Min(Ri,Gi,Bi)=0 is not satisfied, but Min(Ri, Gi,Bi) is a small value closer to 0, Wo is made small, and the degree of enhancement in the luminance is small.

The driver IC 3 performs image processing, in units of the partial area 210, on the input image signals for all the pixels constituting an image to be displayed on the display panel. Simply by following the basic principle, a part of the video may possibly be extremely bright, and the other part thereof may possibly be dark. As a result, if a portion having higher saturation (e.g., a portion of a simple color) is present in a bright background having lower saturation, for example, relatively large Wo is set in the background, but relatively small Wo is set in the portion having higher saturation.

Generally, a human sense of colors and brightness (visual characteristics) is greatly affected by a relative difference in brightness from the surroundings. As a result, a portion having relatively lower brightness (e.g., the portion of a simple color) may possibly look dull. This phenomenon is referred to as simultaneous contrast. To prevent the simultaneous contrast in the image processing for replacing the color indicated by an input image signal of R, G, and B with the combination of colors of R, G, B, and W, the present embodiment performs color conversion including arithmetic processing (expansion) for enhancing the luminance of a plurality of pixels constituting an image displayed based on image data. The following describes the color conversion.

Expansion of an input image signal will be described. The expanding unit 35 expands the input image signal Ri, Gi, Bi in a manner maintaining the ratio between Ri, Gi, and Bi as indicated by the following Equations (10) to (12), where α denotes an expansion coefficient determined by the α determining unit 33.

$$Rj=\alpha\times Ri \tag{10}$$

$$Gj=\alpha\times Gi \tag{11}$$

$$Bj=\alpha\times Bi \tag{12}$$

To maintain the display quality of an image signal, the expanding unit 35 preferably performs expansion while maintaining the ratio (luminance ratio) between the gradation values of R, G, and B. The expanding unit 35 also preferably performs expansion while maintaining the gradation-luminance characteristics (gamma) of the input image signal. If the color space resulting from the image processing is RGB, the expansion has its limits. Especially when the color indicated by the input image signal is originally bright, the expanding unit 35 may possibly hardly expand the input image signal.

The liquid crystal display device 1 according to the present embodiment is an RGBW display device and has a larger dynamic range of the luminance because of addition of W. Thus, the liquid, crystal display device 1 can expand the displayable color space. The expansion can be performed to the upper limit of the color space composed of RGB and W. The expansion enables the luminance to exceed a limit value of 255 of the conventional RGB system.

In a case where the brightness of the sub-pixel of W is K times as high as that of the sub-pixels of R, G, and B, for example, the maximum value of Wo is assumed to be 255×K. In this case, the values (luminance) of Rj, Gj, Bj can be increased to (1+K)×255 in the RGBW color space. Thus, it is possible to enhance the luminance of data satisfying Min(Ri,Gi,Ri)=0 or having a small Min(Ri,Gi,Bi) the luminance of which fails to be enhanced by the conventional technology.

Figure 6:
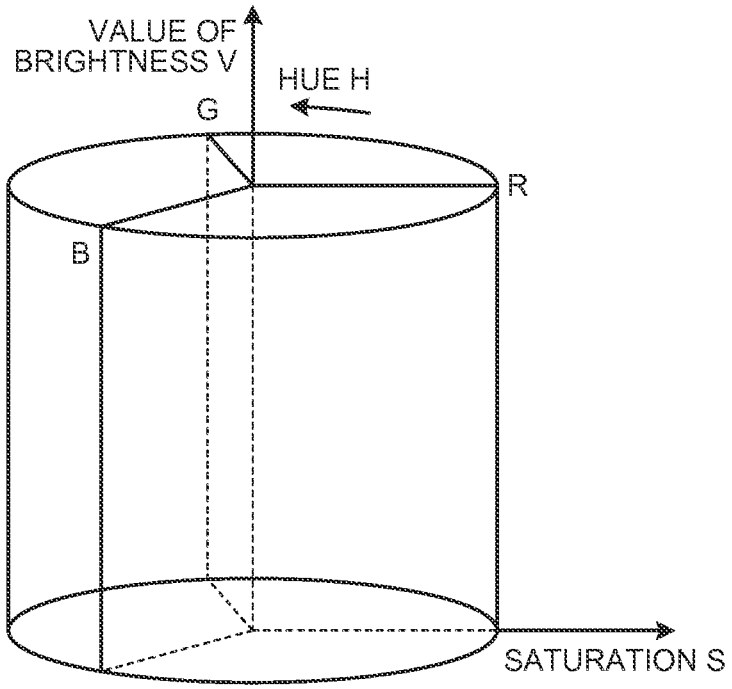
FIG. 6 is a schematic diagram of a color space of an RGB liquid crystal display device.
Figure 7:
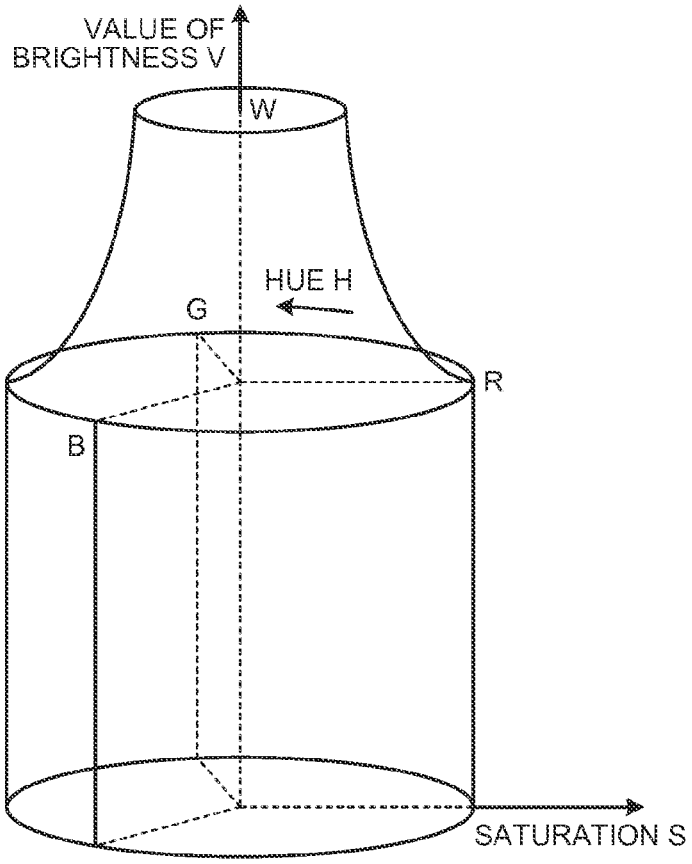
FIG. 7 is a schematic diagram of a color space of an RGBW liquid crystal display device.
Figure 8:
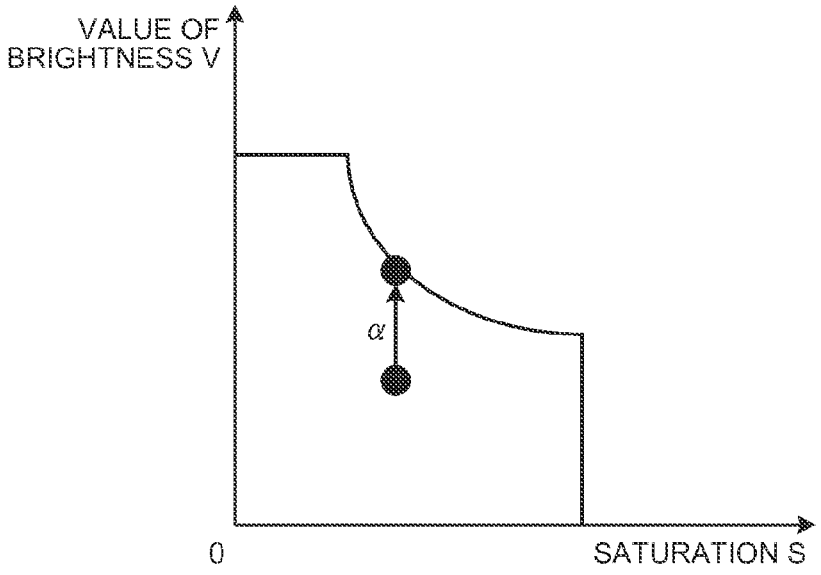
FIG. 8 is a sectional view of an expanded color space of the RGBW liquid crystal display device.

FIG. 6 is a schematic diagram of a color space of an RGB liquid crystal display device. FIG. 7 is a schematic diagram of a color space of an RGBW liquid crystal display device. FIG. 8 is a sectional view of an expanded color space of the RGBW liquid crystal display device. As illustrated in FIG. 6, all colors can be plotted on the coordinates defined by hue (H), saturation (S), and a value of brightness (V). HSV, which is a type of color space, is defined by attributes of the hue, the saturation, and the value of brightness. The hue is a difference in color, such as red, blue, and green, and is an attribute most clearly indicating a difference in an image. The saturation is one of indexes indicating a color and is an attribute indicating the degree of vividness of the color. The value of brightness is an attribute indicating the degree of brightness and the darkness of a color. As the value of brightness is larger, the color looks brighter. In the HSV color space, the hue indicates R at 0° and G and B in a manner following R in the counterclockwise direction on its circumference. The saturation indicates how much gray is mixed in a color and how dull the color is. In the saturation, 0% indicates that the color is the dullest, whereas 100% indicates that the color is not dull at all. In the value of brightness, 100% indicates that the color is the brightest, whereas 0% indicates that the color is the darkest.

While the attributes defining the color space of an RGBW display device are basically the same as those defining the color space of an RGB display device as illustrated in FIG. 7, the addition of W expands the value of brightness. Thus, the difference between the color space of the RGB display device and that of the RGBW display device is represented by the HSV color space defined by H, S, and V. The dynamic range of V expanded by the addition of W greatly varies depending on S.

The present color conversion is performed considering that the coefficient α in the expansion of the input image signal Ri, Gi, Bi varies depending on S. Specifically, the image analyzing unit 32 analyzes the input image signal. Based on the result of the analysis carried out by the image analyzing unit 32, the α determining unit 33 determines the expansion coefficient (α) of each image. Thus, the RGBW display device can display video while maintaining the display quality prior to the image processing.

The α determining unit 33 preferably determines the expansion coefficient (α) for each value of S from 0 to the maximum value (255 in the case of 8 bits) based on the analysis of the input image signal. The α determining unit 33 may use the minimum value of the derived expansion coefficients (α). In this case, the expansion can be performed without deteriorating the display quality prior to the image processing at all. The expansion according to the present embodiment is performed based on the ratio between Max (R,G,B) of the input image and the largest value of brightness V in the HSV color space. The α determining unit 33 calculates the ratio with S from 0 to the maximum value and uses the minimum value as the expansion coefficient (α) to perform the expansion.

To maintain the display duality so the maximum, an analysis is preferably carried out on the input image signals for all the pixels constituting a piece of image data. The analysis is processing for grasping Min(Ri,Gi,Bi) and Max (Ri,Gi,Bi) and is carried out by the image analyzing unit 32. By contrast, to increase the processing speed in the color conversion and downsize the image analyzing unit 32 and the circuit including the image analyzing unit 32, it is preferable that pixels constituting image data be sampled from each partial area 210 and that the input image signals for the sampled pixels be analyzed. Specifically, the image analyzing unit 32 analyzes every n-th input image signal (n is a natural number equal to or larger than 1), for example. To determine the expansion coefficient (α), an ergonomic approach can be naturally employed.

Humans cannot perceive a small local change in the signal Ri, Gi, Ri serving as the input image signal. By increasing the expansion coefficient (α) to the limit of perception of a change in the display quality, it is possible to achieve great expansion while preventing the change in the display quality from being perceived.

As illustrated in FIG. 8, the signal (gradation value) resulting from the image processing is generated based on the expansion coefficient (α) determined by comparing the level of the input image signal with the expanded RGBW color space.

The following describes a method for determining Wo from the expanded image signal Rj, Gj, Bj. As described above, the minimum value Min(Rj,Gj,Bj) of each pixel is preferably calculated by analyzing the expanded image signal Rj, Gj, Bj, and Wo=Min(Ri,Gi,Bi) is preferably set. This is the maximum value of Wo. Thus, Wo is determined by analyzing the expanded image signal Rj, Gj, Bj, calculating the minimum value Min(Rj,Gj,Bj), and setting Wo to the minimum value Min(Rj,Gj,Bj).

When Wo is determined by the method described above, a new RGB image signal is expressed by the following Equations (13) to (15).

$$Ro=Rj-Wo \tag{13}$$

$$Go=Gj-Wo \tag{14}$$

$$Bo=Bj-Wo \tag{15}$$

By expanding the input image signal with the method described above, the value of Wo can be made larger, making it possible to further enhance the luminance of the entire image. By reducing the luminance of the light source 6 to 1/α based on the expansion coefficient (α), it is possible to display at the same luminance as that of the input image signal. By making the luminance of the light source 6 higher than 1/α, it is possible to display at luminance higher than that of the input image signal.

The gradation value resulting from the expansion is generated based on the expansion coefficient (α) determined by comparing the level of the value of brightness of the input image signal with the color space formed by RGBW. Thus, the expansion coefficient (α) is image analysis information obtained by analyzing an image of one frame.

Because the expansion coefficient (α) is determined by comparing the level of the value of brightness of the input image signal with the color space, the expansion coefficient (α) is not changed by a slight change in the image information. Even if an image moving around in the screen is present, for example, the expansion coefficient (α) is constant unless the luminance or the chromaticity significantly changes. Thus, the conversion to RGBW can be performed without any problem using the expansion coefficient (α) determined in a preceding frame.

Before the image analyzing unit 32 analyzes an image, the gamma conversion unit 31 according to the present embodiment performs gamma conversion. In the gamma conversion, for example, the gamma conversion unit 31 changes the value (Rj,Gj,Bj) such that the correspondence relation between the gradation and the luminance of the image indicated by the input image signal, that is, the gradation-luminance characteristics (gamma) is a linear relation. The image analyzing unit 32 according to the present embodiment analyzes the input image signal on which the gamma conversion is performed. The inverse-gamma conversion unit 36 restores the gradation-luminance characteristics (gamma) changed by the gamma conversion performed by the gamma conversion unit 31 into the correspondence relation prior to the gamma conversion. With the gamma conversion performed before the analysis and the inverse-gamma conversion performed after the expansion, it is possible to maintain the gradation-luminance characteristics (gamma) of the input image signal more reliably. The gamma conversion and the inverse-gamma conversion may be omitted.

FIG. 9 is a diagram of an example of input image signals for three pixels Pix sampled in one partial area 210 and various values calculated from the input image signals. While the explanation has been made of processing performed based on an input image signal for one pixel Pix out of a plurality of pixels constituting an image, the a determining unit 33 practically determines α in units of the partial area 210. Specifically, the image analyzing unit 32 calculates the average of the signal levels of the input image signals for the pixels Pix included in one partial area 210 as the average of the gradation values of the partial area 210, for example. As illustrated in FIG. 9, for example, let us assume that the number of sampled pixels out of pixels included in one partial area 210 is three, and the input image signals for the three pixels Pix (Pix 1, Pix 2, and Pix 3) are as follows: (R,G,B)=(0,30,90) for Pix 1, (R,G,B)=(10,30,120) for Pix 2, and (R,G,B)=(20,60,180) for Pix 3. The luminance level determining unit 34 adds up the gradation values of the input image signals (La-1, La-2, and La-3) for the three pixels Pix 1, Pix 2, and Pix 3, respectively, for each color. The luminance level determining unit 34 divides the sum by the number of pixels (three in this assumption), thereby calculating the average of the gradation values of R, G, and B. In this assumption, the average of the gradation values of R is (0+10+20)÷3=10, the average of the gradation values of G is (30+30+60)÷3=40, and the average of the gradation values of B is (90+120+180)÷3=130. Thus, the average (Lb) of she gradation values or the partial area 210 in this assumption is (110, 10, 130). The image analyzing unit 32, for example, calculates the averages of the gradation values of respective partial areas 210. Based on the averages of the gradation values of the respective partial areas 210, for example, the α determining unit 33 determines α of the respective partial areas 210. In this assumption, the average of the gradation values are calculated in units of the partial area 210, and α is determined based on the average of the gradation values. This is given by way of example of the analysis of an image and the determination of α, and the embodiment is not limited thereto. The image analyzing unit 32 performs processing for determining the gradation value serving as a standard for determining α in units of the partial area 210, which is not limited to the average of the gradation values. Examples of factors that determine the gradation value serving as a standard for determining α include, but are not limited to, the peak (the maximum value or the minimum value) of the gradation values of each color constituting the input image signal, the proportion and the distribution of pixels exceeding (or falling below) the average of the gradation values, etc. Based on the factors included in the partial areas 210, the image analyzing unit 32 may determine the gradation value serving as a standard for determining α. The α determining unit 33 holds data or a circuit configuration indicating the correspondence relation for deriving the expansion coefficient (α) corresponding to the gradation value (R,G,B) serving as a standard for determining α, for example. In other words, the correspondence relation between the gradation value (R,G,B) serving as a standard for determining α and the expansion coefficient (α) is determined in advance in the present embodiment. This is given by way of example of a specific configuration of the a determining unit 33, and the embodiment is not limited thereto. The α determining unit 33 may determine the expansion coefficient (α) by software processing, for example.

As described above, the α determining unit 33 serves as an expansion coefficient determining unit that determines, based on the signal levels of R, G, and B indicated by the input image signals, the expansion coefficient of each of the partial areas 210 provided in a manner dividing the display area.

The following describes processing for determining the luminance level. The luminance level, determining unit 34 performs processing for deriving the gradation levels of a plurality of partial areas 210 from the signal levels of red, green, and blue indicated by the input image signals for the partial areas 210. The luminance level is the ratio of gradation of RGB with the luminous efficiency taken into consideration. The luminous efficiency is the degree of intensity of brightness at each wavelength of light sensed by human eyes. Specifically, the ratio of R:G:B indicating the luminous efficiency according to the present embodiment is 3:6:1. This is given by way of example of the value indicating the luminous efficiency of each color. The embodiment is not limited thereto, and the ratio can be appropriately chanced. The standard relative luminous efficiency, for example, may be used as the luminous efficiency for determining the luminance level according to the present invention. The following describes processing for deriving the gradation levels of R, G, and B of a partial area 210 from the signal levels of R, G, and B indicated by the input image signals for the partial area 210.

The luminance level determining unit 34 derives the average of the gradation levels for each of RGB. Specifically, the luminance level determining unit 34 calculates a value corresponding to the average of the signal levels (gradation values) of R, G, and B constituting the input image signals for the respective pixels Pix included in the partial area 210 as the average of the gradation levels. The average of the gradation values derived by the luminance level determining unit 34 is identical to the average of the gradation values calculated by the image analyzing unit 32. The luminance level determining unit 34 may use the average of the gradation values calculated by the image analyzing unit 32 or may calculate the average of the gradation values for itself. The luminance level determining unit 34 may use the average of the gradation values as the average of the gradation levels without any change. Alternatively, the luminance level determining unit 34 may use a value based on the average (e.g., a value obtained by performing another operation on the average of the gradation values) as the average of the gradation levels. Let us assume that a value obtained by dividing the average of the gradation values by 10 is used as the average of the gradation levels in the assumption described above. In this case, the averages (Lc) of the gradation levels of R, G, and B are "1", "4", and "13", respectively.

Subsequently, the luminance level determining unit 34 multiplies the average of the gradation levels by the ratio of the luminous efficiency. Specifically, the luminance level determining unit 34 multiplies the values of R, G, and B indicating the average of the gradation levels by values with the luminous efficiency (e.g., R:G:B=3:6:1) taken into consideration, thereby calculating the average of the gradation levels with the luminous efficiency taken into consideration. The luminance level determining unit 34 according to the present embodiment multiplies the values of R, G, and B indicating the average of the gradation levels by 0.3, 0.6, and 0.1, respectively. This is given by way of example only, and the embodiment is not limited thereto. When the values of R, G, and B ("1", "4", and "13") indicating the average of the gradation levels are multiplied by 0.3, 0.6, and 0.1, the calculation results are "0.3", "2.4", and "1.3", respectively. These values are derived as the average (Ld) of the gradation levels with the luminous efficiency taken into consideration.

The luminance level determining unit 34 adds up the averages of the gradation levels with the luminous efficiency taken into consideration by the multiplication of the ratio of the luminous efficiency, thereby determining the luminance level based on the sum of the averages. When "0.3", "2.4", and "1.3" calculated as the average of the gradation levels with the luminous efficiency taken into consideration in the assumption are added up, the calculation result is "4", for example. The luminance level determining unit 34 may use the sum (Le) of the averages of the gradation levels added up in this manner as the luminance level without any change. Alternatively, the luminance level determining unit 34 may use a value based on the sum (e.g., a value obtained by performing another operation on the average of the gradation values) as the luminance level. The luminance level determined in this manner indicates the intensity of luminance of each partial area 210.

The explanation has been made of the processing for deriving the gradation levels of a partial area 210 from the signal levels of red, green, and blue indicated by the input image signals for the partial area 210. The luminance level determining unit 34 performs the processing on the partial areas 210 individually. The luminance level determining unit 34 determines the luminance levels of the input image signals for a plurality of pixels included in a partial area having a luminance level equal to or higher than a predetermined threshold, which will be described later.

The driver IC 3 performs processing in order of the gamma conversion performed by the gamma conversion unit 31, the analysis performed by the image analyzing unit 32, the determination of the expansion coefficient (e.g., α) performed by the α determining unit 33, the determination of the luminance level performed by the luminance level determining unit 34, the expansion performed, by the expanding unit 35, and the inverse-gamma conversion performed by the inverse-gamma conversion unit 36, for example. The driver IC 3 outputs information (the expansion coefficient (α) and the luminance level) for controlling the brightness of the light source 6 to the backlight controller 4.

The following describes control of the backlight performed by the backlight controller 4. The backlight controller 4 performs the control of the backlight such that the brightness of the light source 6 in a partial area 210 having a luminance level equal to or higher than a predetermined threshold is higher than the brightness based on the expansion coefficient.

Figure 11:
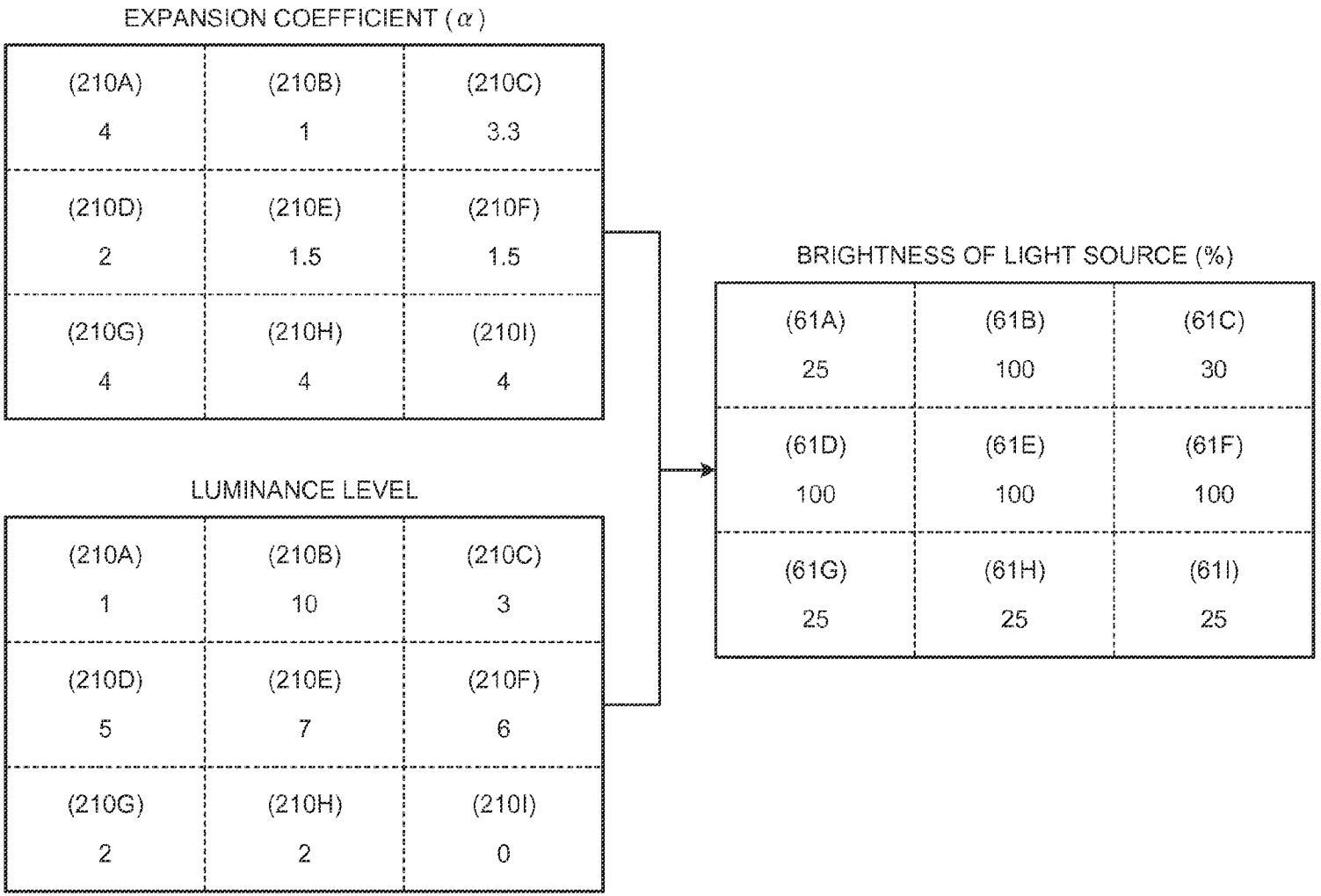
FIG. 11 is a diagram of an example of the relation between the expansion coefficient of the partial areas and the brightness of the light source in a case where the brightness of the light source in partial areas having a luminance level equal to or higher than a predetermined threshold is made higher than the brightness based on the expansion coefficient.

FIG. 10 is a diagram of an example of a relation between the expansion coefficient (α) of the partial areas 210A to 210I and the brightness of the light source 6. In FIG. 10 and FIG. 11, which will be described later, OLEDs corresponding to the partial areas 210A to 210I are denoted by reference numerals 61A to 61I, respectively. If the expanding unit 35 performs expansion based on the expansion coefficient (α), the backlight controller 4 sets the brightness of the backlight to brightness corresponding to the reciprocal (1/α) of the expansion coefficient (α). Thus, color reproduction is performed with the luminance corresponding to the signal level of the input image signal. Specifically, as illustrated in the partial area 210A arranged on the upper left in FIG. 10, the backlight controller 4 sets the brightness of the light source 6 (OLED 61A) of the backlight in the partial area 210A having an expansion coefficient (α) used for expansion of "4" to the brightness of 25%, for examle. In other words, the backlight controller 4 uses "1/4" corresponding to the reciprocal of the expansion coefficient (α=4) of the partial area 210A arranged on the upper left to control the brightness of the light source 6 (OLED 61A) of the backlight. The backlight controller 4 performs the same light-source control on the other partial areas 210. In the example illustrated in FIG. 10, the backlight controller 4 sets the brightness of the light source 6 of the backlight in the partial areas 210 having expansion coefficients (α) of "1", "1.5", "2", and "3.3" to "100% (1/1)", "67%) (2/3)", "50% (1/2)", and "30% (3/10)", respectively. Thus, the backlight controller 4 controls the brightness of she light source 6 of the backlight in each partial area 210 based on the expansion coefficient (α) of each partial area 210. The expanding unit 35 determines the gradation value (Ro,Go,Bo,Wo) of a pixel Pix included in each partial area 210 based on the expansion coefficient (α). The gradation value of a pixel Pix corresponds to the transmittance of the sub-pixels Vpix included in the pixel Pix. In other words, the gradation value (Ro,Go,Bo,Wo) of the pixel Pix resulting from the expansion corresponds to the transmittance of the pixel Pix including the sub-pixels Vpix. As described above, the brightness of the light source 6 is controlled so as to be the brightness corresponding to the reciprocal (1/α) of the expansion coefficient (α) unless luminance enhancement, which will be described later, is performed. In other words, the expansion coefficient (α) indicates the relation between the transmittance corresponding to the gradation value (Ro,Go,Bo,Wo) of the pixel Pix expanded by the expansion and the brightness of the light source 6 controlled based on the transmittance. When α=1 is satisfied, for example, the ratio between the transmittance in the expansion and the brightness of the light source 6 is 1:1. When α=2 is satisfied, the ratio between the transmittance in the expansion and the brightness of the light source 6 is 2:0.5. Thus, the expansion coefficient (α) of each partial area 210 indicates the relation between the transmittance of the pixel Pix and the brightness of the light source 6. The example illustrated in FIG. 10, however, indicates the relation between the expansion coefficient (α) and the brightness of the light source 6 when control of the brightness of the light source 6 is not performed based on the relation between the luminance level and a predetermined threshold.

FIG. 11 is a diagram of an example of the relation between the expansion coefficient (α) of the partial areas 210A to 210I and the brightness of the light source 6 when the brightness of the light source 6 in partial areas having a luminance level equal to or higher than a predetermined threshold is made higher than the brightness based on the expansion coefficient (α). The expansion coefficients (α) of the partial areas 210 illustrated in FIG. 11 are identical to those of the partial areas 210 illustrated in FIG. 10. As illustrated in FIG. 11, for example, let us assume that the partial areas 210 are provided in a manner dividing the display area into nine, and that the luminance levels (e.g., the sum of the averages of the gradation levels with she luminous efficiency taken into consideration (Le in FIG. 9)) of the nine partial areas 210A to 210I are "1", "10", "3", "5", "7", "6", "2", "2", and "0". The assignment procedure of the luminance levels is as follows: the assignment is started from the luminance level of the partial area 210A arranged on the upper left out of the 3×3 partial areas 210 illustrated in FIG. 11; the luminance levels are sequentially assigned to the partial areas 210 toward right along the row direction (horizontal direction in FIG. 11); when the assignment of all the partial areas 210 in the first row is finished, the assignment is shifted to the leftmost partial area 210 in the second row next to the first row in the column direction (vertical direction in FIG. 11); the luminance levels are sequentially assigned so the partial areas 210 toward right; and the above procedure is repeated.

In a case where she predetermined threshold is "5" in the example illustrated in FIG. 11, the partial areas 210B, 210D, 210E, and 210F having luminance levels of "10", "5", "7", and "6", respectively, correspond to the partial areas 210 having a luminance level equal to or higher than the predetermined threshold. In this case, the backlight controller 4 makes the brightness of the light source 6 of the backlight in the partial areas 210B, 210D, 210E, and 210F higher than the brightness based on the expansion coefficient (α). The backlight controller 4, for example, sets the brightness of the light source 6 in the partial areas 210 having a luminance level equal to or higher than the predetermined threshold to the highest brightness. Specifically, as illustrated in FIG. 11, the backlight controller 4 performs luminance enhancement to set the brightness of the light source 6 of the backlight in the partial areas 210B, 210D, 210E, and 210F having luminance levels of "10", "5", "7", and "6", respectively, to "100%". As described above, the backlight controller 4 performs the control of the backlight such that the brightness of the light source 6 in the partial areas 210 having a luminance level equal to or higher than the predetermined threshold is higher than the brightness based on the expansion coefficient (α), thereby achieving brighter display output. As a result, it is possible to sufficiently secure the brightness with respect to required brightness. The predetermined threshold may be arbitrarily set.

The backlight controller 4 according to the present embodiment controls the brightness of the light source 6 of the backlight by performing pulse width modulation (PWM) control. In other words, the backlight controller 4 can set the duty ratio in the supply of electric power (e.g., chopper control) to the light source 6 in the partial areas 210 individually. Thus, the backlight controller 4 controls the brightness of the light source 6 of the backlight in the partial areas 210 individually.

The brightness of the light source 6 in the partial area 210 having a luminance level equal to or higher than the predetermined threshold is made higher than the brightness based on the expansion coefficient (α). In this case, however, color reproduction with higher brightness is not necessarily suitable for the input image signals for all the pixels Pix included in the partial area 210. To address this, in the present embodiment, processing for reducing the brightness of a pixel corresponding to an input image signal determined to be unsuitable for color reproduction with higher brightness is performed. In the processing, the present embodiment reduces the brightness of a pixel out of a plurality of pixels included in a partial area 210 in which the backlight is controlled, to perform display with the brightness higher than that based on the expansion coefficient (α). Specifically, the luminance level determining unit 34 determines the luminance levels of the input image signals for the respective pixels included in the partial area 210 having a luminance level equal to or higher than the predetermined threshold. The signal processing unit (e.g., the expanding unit 35) performs no expansion on an input image signal having a luminance level lower than that of the partial area 210 out of the input image signals for she respective pixels included in the partial area 210 having a luminance level equal to or higher than the predetermined threshold.

Figure 12:
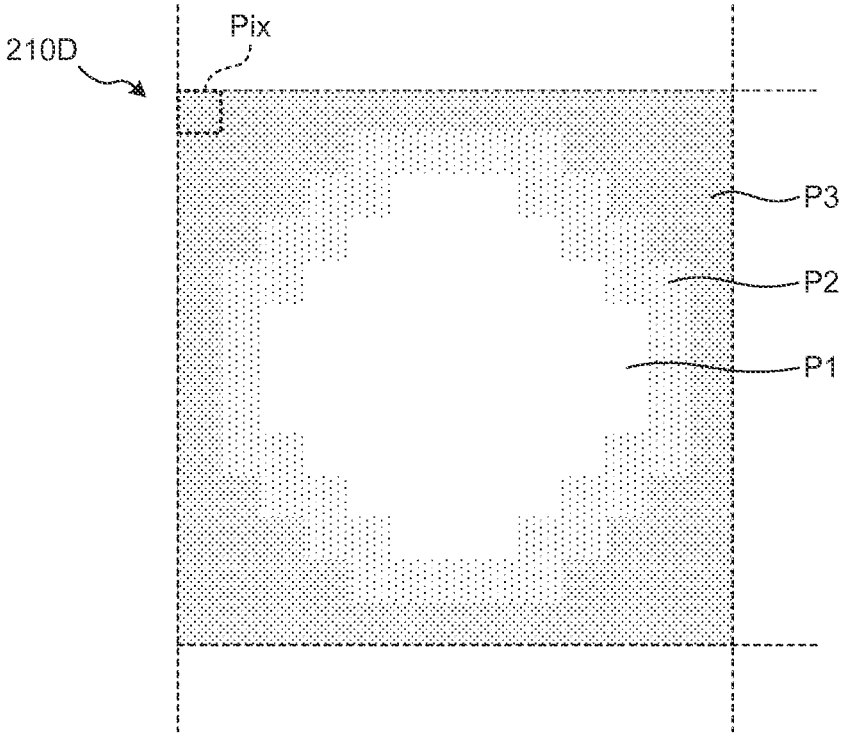
FIG. 12 is a schematic diagram of an example of differences in brightness caused by differences in the signal level of the input image signals for the respective pixels included in a partial area.

FIG. 12 is a schematic diagram of an example of differences in brightness caused by differences in the signal level of the input image signals for the respective pixels Pix included in the partial area 210D. Let us assume that the luminance level of the partial area 210D illustrated in FIG. 12 is determined to be higher than the predetermined threshold, for example. In this case, the backlight controller 4 performs luminance enhancement for making the brightness of the light source 6 of the backlight higher than the value based on the expansion coefficient (α). In the backlight of the partial area 210D illustrated in FIG. 12, the brightness of the light source 6 is set to "100%" by the luminance enhancement. The expanding unit 35 performs no expansion on input image signals having a luminance level lower than that of the partial area out of the input image signals for the respective pixels Pix included in the partial area 210D illustrated in FIG. 12, that is, out of the input image signals for the respective pixels included in the partial area having a luminance level equal to or higher than the predetermined threshold.

Specifically, the luminance level determining unit 34 determines the luminance levels of the input image signals for the respective pixels included in the partial area having a luminance level equal to or higher than the predetermined threshold. In the example illustrated in FIG. 12, the luminance level determining unit 34 determines the luminance level of each of the input image signals for the respective pixels Pix included in the partial area 210D. More specifically, the luminance level determining unit 34 multiplies the gradation values of the colors (e.g., R, G, and B) indicated by the input image signals for the respective pixels Pix included in the partial area 210D by the ratio of the luminous efficiency, for example. The luminance level determining unit 34 adds up the gradation values with the luminous efficiency taken into consideration by the multiplication of the ratio of the luminous efficiency in units of the input image signal. The luminance level determining unit 34 determines the luminance level of each input image signal based on the sum of the gradation values. In other words, to determine the luminance level of a partial area 210, the luminance level determining unit 34 uses the average of the gradation values indicated by the input image signals for the respective pixels included in the partial area 210. By contrast, to determine the luminance level of each pixel Pix, the luminance level determining unit 34 uses the gradation value of the input image signal for the pixel Pix without any change instead of the average of the gradation values. Apart from that point, the luminance level determining unit 34 determines the luminance level of the input image signal for the pixel Pix in the same manner as in the case of the partial area 210.

The luminance levels of the input image signals for the pixels Pix included in the partial area 210D illustrated in FIG. 12 are "8", "4", and "2", for example. In FIG. 12 and the following description, P1 denotes a pixel area corresponding to the input image signals having a luminance level of "8", P2 denotes a pixel area corresponding to the input image signals having a luminance level of "4", and P3 denotes a pixel area corresponding to the input image signals having a luminance level of "2". The pixel area is composed of a pixel Pix or an aggregation of pixels Pix. The shape of the pixels Pix constituting the pixel areas, the number of pixels, and the output contents illustrated in FIG. 12 are given by way of schematic example only.

In the example illustrated in FIG. 12, the luminance level of the partial area 210D is "6". The input image signals having a luminance level of "4" or "2" (input image signals for the pixels in the pixel areas P2 and P3) have a luminance level lower than that of the partial area 210D. The expanding unit 35 does not expand the signal levels of red, green, and blue indicated by these input image signals. In other words, the expanding unit 35 performs no expansion on the pixels Pix not desired to perform brighter output out of the pixels Pix included in the partial area 210D in which the brightness of the light source 6 of the backlight is made higher. This mechanism makes it possible to perform output equivalent to that in a case where no enhancement is performed on the light source 6. By contrast, the input image signals having a luminance level of "8" (input image signals for the pixels in the pixel area P1) have a luminance level equal to or higher than that of the partial area 210D. The expanding unit 35 performs expansion on these input signals using the expansion coefficient (α) of the partial area. This mechanism makes it possible to perform brighter output only in the pixels Pix desired to perform brighter output (input image signals for the pixels in the pixel area P1).

The following describes an exemplary flow of expansion and processing for controlling the light source 6 of the backlight with reference to FIG. 13. FIG. 13 is an exemplary flowchart of expansion and processing for controlling the light source 6 of the backlight. The flowchart indicates an example of a series of processing performed on input image signals for a plurality of pixels constituting an image of one frame displayed by the liquid crystal display device 1. Every time the image is updated, the series of processing is repeated.

The α determining unit 33 determines the expansion coefficient (α) of a plurality of partial areas 210 from the result of an analysis carried out by the image analyzing unit 32 based on the signal levels of red, green, and blue indicated by input image signals (Step S1). The luminance level determining unit 34 determines the luminance level of each of the partial areas 210 based on the signal levels of red, green, and blue indicated by the input image signals (Step S2). The processing at Step S1 and the processing at Step S2 may be performed in reverse order.

The backlight controller 4 controls the brightness of the light source 6 of the backlight in the partial areas 210 based on the expansion coefficient (α) of the partial areas 210. Specifically, the backlight controller 4 selects a partial area 210 in which the brightness of the light source 6 is not determined yet out of the partial areas 210 (Step S3).

The backlight controller 4 determines whether the luminance level of the partial area 210 selected at Step S3 is equal to or higher than a predetermined threshold (Step S4). If the backlight controller 4 determines that the luminance level is equal to or higher than the predetermined threshold (Yes at Step S4), the backlight controller 4 makes the brightness of the light source 6 in the partial area 210 selected at Step S3 higher than the brightness based on the expansion coefficient (α). Specifically, for example, the backlight controller 4 sets the brightness of the light source 6 in the partial area 210 having a luminance level equal to or higher than the predetermined threshold to the highest brightness (e.g., 100%) (Step S5).

By contrast, if the backlight controller 4 determines chat the luminance level is not equal no or higher than the predetermined threshold (No at Step S4), the backlight controller 4 sets the brightness of the light source 6 in the partial area 210 selected at Step S3 to the brightness corresponding to the reciprocal of the expansion coefficient (α) of the partial area 210 (Step S6).

After the processing at Step S5 or Step S6, the backlight controller 4 determines whether the brightness of the light source 6 is determined in all the partial areas 210 (Step S7). If the backlight controller 4 determines that the brightness of the light source 6 is not determined in all the partial areas 210, that is, if there is a partial area 210 in which the brightness of the light source 6 is not determined yet (No at Step S7), the process is returned to Step S3.

If the backlight controller 4 determines that the brightness of the light source 6 is determined in all the partial areas 210 at Step S7 (Yes at Step S7), the expanding unit 35 determines whether a partial area 210 determined to have a luminance level equal to or higher than the predetermined threshold is present, that whether a partial area 210 is present in which the brightness of the light source 6 is made higher than the brightness based on the expansion coefficient (α) (Step S8).

If the expanding unit 35 determines that no partial area 210 is present in which the brightness of the light source 6 is made higher than the brightness based on the expansion coefficient (α) (No at Step S8), the expanding unit 35 performs expansion on the pixels included in the partial areas 210 using the expansion coefficient (α) of the partial areas 210 (Step S9).

By contrast, if the expanding unit 35 determines that partial areas 210 are present in which the brightness of the light source 6 is made higher than the brightness based on the expansion coefficient (α) (Yes at Step S8), the expanding unit 35 selects a partial area 210 in which the luminance levels of the input image signals are not determined yet out of the partial areas 210 in which the brightness of the light source 6 is made higher than the brightness based on the expansion coefficient (α) (Step S10). The expanding unit 35 determines the luminance levels of the input image signals for the respective pixels included in the partial area 210 selected at Step S10 (Step S11). The expanding unit 35 selects a pixel for which whether to perform expansion is not determined yet out of the pixels included in the partial area 210 selected at Step S10 (Step S12). The expanding unit 35 determines whether the luminance level of the pixel selected at Step S12 is equal to or higher than the luminance level of the partial area 210 selected at Step S10 (Step S13).

If the expanding unit 35 determines that the luminance level of the pixel is equal to or higher than that of the partial area 210 (Yes at Step S13), the expanding unit 35 performs expansion on the pixel selected at Step S12 using the expansion coefficient (α) of the partial area 210 selected at Step S10 (Step S14).

By contrast, if the expanding unit 35 determines that the luminance level, of the pixel is lower than that of the partial area 210 (No at Step S13), the expanding unit 25 performs no expansion on the pixel selected at Step S12 (Step S15). After the processing at Step S14 or Step S15, the expanding unit 35 determines whether the determination on whether to perform expansion is complete in all the pixels included in the partial area 210 selected at Step S10 (Step S16).

If the expanding unit 35 determines that the determination on whether to perform expansion is not completed yet in all the pixels included in the partial area 210 (No at Step S16), the process is returned to Step S12. By contrast, if the expanding unit 35 determines that the determination on whether to perform expansion is completed in all the pixels included in the partial area 210 (Yes at Step S16), the expanding unit 35 determines whether the determination of the luminance levels of the pixels and the determination on whether to perform expansion are completed in all the partial areas 210 in which the brightness of the light source 6 is made higher than the brightness based on the expansion coefficient (α) (Step S17). If the expanding unit 35 determines that a partial area 210 is present for which the determination of the luminance levels of the pixels and the determination on whether to perform expansion is not completed yet at Step S17 (No at Step S17), the process is returned to Step S10.

By contrast, if the expanding unit 35 determines that the determination of the luminance levels of the pixels and the determination on whether to perform expansion are completed in all the partial areas 210 in which the brightness of the light source 6 is made higher than the brightness based on the expansion coefficient (α) (Yes at Step S17), the expanding unit 35 performs processing at Step S18. The expanding unit 35 performs expansion on the pixels included in the partial area 210 using the expansion coefficient (α) of the partial area 210 (Step S18), the partial area 210 being an area determined to have a luminance level lower than the predetermined threshold, that is, an area in which the brightness of the light source 6 is controlled to be the brightness based on the expansion coefficient (α). Subsequently, the processing on the image of one frame is terminated. The processing at Step S18 and the processing from Step S10 to Step S17 may be performed in arbitrary order.

In the flowchart illustrated in FIG. 13 and the explanation thereof, the brightness of the light source 6 in each of the partial areas 210 is determined one by one. This is given by way of example of the processing flow, and the embodiment is not limited thereto. The present embodiment, for example, may determine the brightness of a part or all of the light sources 6 in the partial areas 210 in parallel. In the processing for determining the brightness of the light source 6 in the partial areas 210, it is only necessary that the brightness of the light source 6 in the partial areas 210 having a luminance level equal to or higher than the predetermined threshold is made higher than the brightness based on the expansion coefficient (α). The processing may be performed in arbitrary order without departing from the aim. In the present embodiment, for example, the brightness of the light source 6 in the partial areas 210 having a luminance level equal to or higher than the predetermined threshold may be set at the highest brightness. Subsequently, the brightness of the light source 6 in the partial areas 210 having a luminance level lower than the predetermined threshold may be set at the brightness corresponding to the reciprocal of the expansion coefficient (α).

In the flowchart illustrated in FIG. 13 and the explanation thereof, the luminance levels of the pixels included in the partial area 210 on which luminance enhancement is performed and whether to perform expansion are determined after completing the processing relating to the brightness of the light source 6 of the backlight in all the partial areas 210. This is given by way of example of the processing flow, and the embodiment is not limited thereto. For example, the processing relating to the brightness of the light source 6 in a partial area 210 may be performed, and then the luminance levels of the pixels and whether to perform expansion may be determined only when the luminance enhancement is performed on the partial area 210. This processing on the partial areas 210 may be performed individually or in parallel. The processing from Step S11 to Step S16 may be performed in parallel on a part or all of the partial areas 210 on which the luminance enhancement is performed. The processing from Step S12 to Step S15 may be performed in parallel on a part or all of the pixels.

As described above, in the present embodiment, the brightness of the light source 6 in a partial area 210 having a luminance level equal to or higher than the predetermined threshold is made higher than the brightness based on the expansion coefficient (α). Thus, brighter display output can be achieved. In other words, whether the display contents (e.g., the color and the proportion of the contents of brighter display output) are desired to perform brighter display can be determined in the units of the partial area 210 based on the signal levels of red, green, and blue indicated by the input image signals. By setting the brightness of the light source 6 in the partial area 210 having a luminance level equal to or higher than the predetermined threshold to be higher than the brightness based on the expansion coefficient (α), brighter display output can be achieved in the partial area 210 desired to perform brighter output.

In the present embodiment, no expansion is performed on the input image signal having a luminance level lower than that of the partial area 210 having a luminance level equal to or higher than the predetermined threshold out of the input image signals for the respective pixels included in the partial area 210. This can reduce the brightness only of the pixel Pix unsuitable for brighter output out of the pixels Pix included in the partial area 210 in which the light source 6 is controlled to perform brighter output. In other words, both brighter output and expression of contrast among the pixels can be achieved.

In the present embodiment, the averages of the gradation levels of red, green, and blue indicated by the input image signals are calculated individually. Then, the luminance level is determined based on the sum of values obtained by multiplying the average of the gradation levels of each color by the ratio of the predetermined luminous efficiency. Thus, it is possible to control the brightness while considering the degree of intensity of brightness at each wavelength of light sensed by human eyes.

In the present embodiment, the brightness of the light source 6 in the partial area 210 having a luminance level equal to or higher than the predetermined threshold is set to the highest brightness. Thus, the output contents desired to perform brighter output can be made bright to the maximum. By uniformly setting the brightness of the light source 6 in the partial areas 210 having a luminance level equal to or higher than the predetermined threshold to the highest brightness, it is possible to simplify the brightness of the light source 6 in the partial areas 210.

Figure 14:
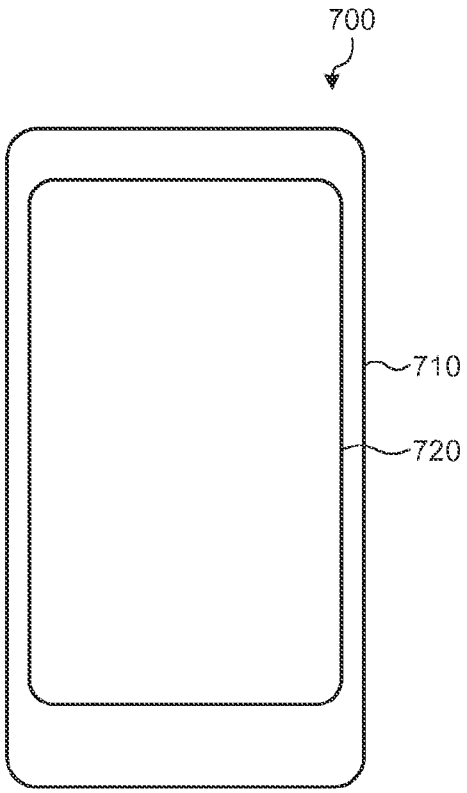
FIG. 14 is a schematic diagram of an example of an appearance of a smartphone to which the present invention is applied.

The following describes an application example of the liquid crystal display device 1 according to the embodiment above with reference to FIG. 14. The liquid crystal display device 1 according to the embodiment above is applicable to electronic apparatuses in all fields, such as smartphones. In other words, the liquid crystal display device 1 is applicable to electronic apparatuses in all fields that display video signals received from the outside or generated inside thereof as an image or video.

FIG. 14 is a schematic diagram of an example of an appearance of a smartphone 700 to which the present invention is applied. The smartphone 700 includes a display unit 720 on a surface of a housing 710, for example. The display unit 720 corresponds to the liquid crystal display device 1 according to the present invention.

The color of the sub-pixel for outputting the fourth color according to the present invention may be a color other than W. The color may be a complementary color of R, G, and B, such as yellow (Y), or another color. The first, the second, and the third colors are not limited to R, G, and B, respectively, and may be appropriately changed.

The brightness of the light source 6 in the partial area 210 having a luminance level equal to or higher than the predetermined threshold may be gradually controlled. Specifically, the degree of an increase in the brightness of the light source 6 may be determined depending on the magnitude of the difference between the luminance level and the predetermined threshold by stepwise or continuous control.

Figure 15:
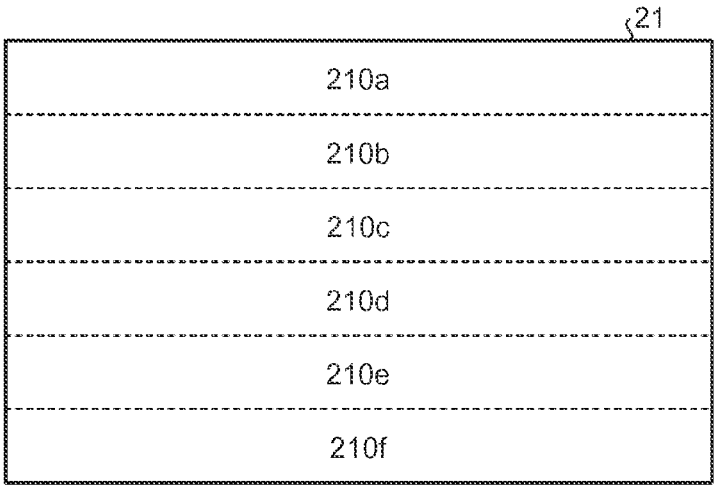
FIG. 15 is a diagram of another example of a plurality of partial areas that divide the display area.

The shape and she number of the partial areas 210 may be arbitrarily set. FIG. 15 is a diagram of another example of a plurality of partial areas 210 (partial areas 210*a* to 210*f*) that divide the display area. As illustrated in FIG. 15, for example, the partial areas 210*a* to 210*f* may be provided in a manner dividing the display area into a stripe pattern wish boundary lines expanding along a predetermined direction. In this case, the partial areas 210*a* to 210*f* may be provided in a manner corresponding to the light source 6 of the backlight individually controlled by local dimming, for example. The light source 6 corresponding to the partial areas 210*a* to 210*f* formed in a stripe pattern illustrated in FIG. 15 includes a plurality of light guide plates and a plurality of light-emitting devices (e.g., light-emitting diodes (LEDs)). The light guide plates have a shape corresponding to the partial areas 210*a* to 210*f* formed in a stripe pattern, for example. The light-emitting devices cause light to enter the respective light guide plates.

The luminance level determining unit 34 according to the present embodiment individually calculates the gradation levels of the first, the second, and the third colors (e.g., three colors of R, G, and B) indicated by the input image signals. The luminance level determining unit 34 determines the luminance level of the partial area 210 based on the sum of values obtained by multiplying the gradation levels of the respective colors by the ratio of the predetermined luminous efficiency. The luminance level determining unit 34, however, may determine the luminance level of the partial area 210 with another method. Specifically, the luminance level determining unit 34 may determine the highest luminance level of the luminance levels of input image signals for the respective pixels included in a partial area 210 to be the luminance level of the partial area 210. In this case, the input image signals for determining the highest luminance level may be input image signals for all the pixels included in the partial area 210 or input image signals for partial pixels sampled from the partial area 210.

The present disclosure includes the following aspects.

(1) A liquid crystal display device comprising:

a display pixel unit having a display area in which a plurality of pixels are arranged in a matrix, the pixels each including sub-pixels of a first color, a second color, a third color, and a fourth color;

a light source that outputs light to be incident on the display pixel unit, the light passing through the pixels and being controlled based on input image signals no display an image;

an expansion coefficient determining unit that determines an expansion coefficient for each of a plurality of partial areas based on a signal level of the first color, the second color, and the third color indicated by the input image signals, the expansion coefficient indicating a relation between transmittance of the pixels and brightness of the light source, the partial areas being provided in a manner dividing the display area;

a luminance level determining unit that determines a luminance level of each of the partial areas based on the signal level of the first color, the second color, and the third color indicated by the input image signals;

a signal processing unit that uses the expansion coefficient to expand the signal level of the first color, the second color, and the third color indicated by the input image signals, extracts a signal component of the fourth color from the expanded signals of the first color, the second color, and the third color, and determines the signal level of the first color, the second color, the third color, and the fourth color based on the extracted signal component of the fourth color; and a light source control unit that controls the brightness of the light source based on the expansion coefficient and the luminance level, wherein the light source is capable of changing the brightness of the partial areas individually, and the light source control unit controls the light source such that the brightness of the light source in a partial area having a luminance level equal to or higher than a predetermined threshold is higher than the brightness based on the expansion coefficient.

(2) The liquid crystal display device according to (1), wherein the luminance level determining unit determines respective luminance levels of the input image signals for the respective pixels included in the partial area having a luminance level equal to or higher than the predetermined threshold, and the signal processing unit performs no expansion on an input image signal having a luminance level lower than the luminance level of the partial area out of the input image signals for the respective pixels included in the partial area having a luminance level equal to or higher than the predetermined threshold.

(3) The liquid crystal display device according to (1) or (2), wherein the luminance level determining unit individually calculates a gradation level of each of the first color, the second color, and the third color indicated by the input image signals and determines the luminance level based on the sum of values obtained by multiplying the gradation level of the colors by a ratio of predetermined luminous efficiency.

(4) The liquid crystal display device according to (1) or (2), wherein the luminance level determining unit determines the highest luminance level of luminance levels of the input image signals for the respective pixels included in a partial area to be the luminance level of the partial area.

(5) The liquid crystal display device according to (1) or (2), wherein the light source control unit sets the brightness of the light source in the partial area having a luminance level equal to or higher than the predetermined threshold to the highest brightness.

The present invention naturally provides advantageous effects obviously derived from the present specification or appropriately conceivable by those skilled in the art out of the other advantageous effects provided by the aspect according to the present embodiment.

What is claimed is:

1. A liquid crystal display device comprising:

a display pixel unit having a display area in which a plurality of pixels are arranged in a matrix, the pixels each including sub-pixels of a first color, a second color, a third color, and a fourth color;

a light source that outputs light to be incident on the display pixel unit, the light passing through the pixels and being controlled based on input image signals no display an image;

an expansion coefficient determining unit that determines an expansion coefficient for each of a plurality of partial areas based on a signal level of the first color, the second color, and the third color indicated by the input image signals, the expansion coefficient indicating a relation between transmittance of the pixels and brightness of the light source, the partial areas being provided in a manner dividing the display area;

a luminance level determining unit that determines a luminance level of each of the partial areas based on the signal level of the first color, the second color, and the third color indicated by the input image signals;

a signal processing unit that uses the expansion coefficient to expand the signal level of the first color, the second color, and the third color indicated by the input image signals, extracts a signal component of the fourth color from the expanded signals of the first color, the second color, and the third color, and determines the signal level of the first color, the second color, the third color, and the fourth color based on the extracted signal component of the fourth color; and a light source control unit that controls the brightness of the light source based on the expansion coefficient and the luminance level, wherein the light source is capable of changing the brightness of the partial areas individually, and the light source control unit controls the light source such that the brightness of the light source in a partial area having a luminance level equal to or higher than a predetermined threshold is higher than the brightness based on the expansion coefficient.

2. The liquid crystal display device according to claim 1, wherein the luminance level determining unit determines respective luminance levels of the input image signals for the respective pixels included in the partial area having a luminance level equal to or higher than the predetermined threshold, and the signal processing unit performs no expansion on an input image signal having a luminance level lower than the luminance level of the partial area out of the input image signals for the respective pixels included in the partial area having a luminance level equal to or higher than the predetermined threshold.

3. The liquid crystal display device according to claim 1, wherein the luminance level determining unit individually calculates a gradation level of each of the first color, the second color, and the third color indicated by the input image signals and determines the luminance level based on the sum of values obtained by multiplying the gradation level of the colors by a ratio of predetermined luminous efficiency.

4. The liquid crystal display device according to claim 1, wherein the luminance level determining unit determines the highest luminance level of luminance levels of the input image signals for the respective pixels included in a partial area to be the luminance level of the partial area.

5. The liquid crystal display device according to claim 1, wherein the light source control unit sets the brightness of the light source in the partial area having a luminance level equal to or higher than the predetermined threshold to the highest brightness.

* * * * *